US010421181B1

(12) United States Patent
Cox

(10) Patent No.: US 10,421,181 B1
(45) Date of Patent: Sep. 24, 2019

(54) FLAT MULTIPLE TOOL

(71) Applicant: Adam Thomas Cox, Wichita, KS (US)

(72) Inventor: Adam Thomas Cox, Wichita, KS (US)

( * ) Notice: Subject to any disclaimer, the term of this patent is extended or adjusted under 35 U.S.C. 154(b) by 117 days.

(21) Appl. No.: 15/610,138

(22) Filed: May 31, 2017

(51) Int. Cl.

| | |
|---|---|
| ***B25G 1/06*** | (2006.01) |
| ***B25B 15/00*** | (2006.01) |
| ***B26B 29/02*** | (2006.01) |
| ***B26B 11/00*** | (2006.01) |
| ***B25G 1/08*** | (2006.01) |
| ***B25F 1/00*** | (2006.01) |
| ***B25F 1/02*** | (2006.01) |

(52) U.S. Cl.
CPC ..... *B25G 1/063* (2013.01); *B25B 15/007* (2013.01); *B25F 1/00* (2013.01); *B25F 1/02* (2013.01); *B25G 1/085* (2013.01); *B26B 11/00* (2013.01); *B26B 29/025* (2013.01)

(58) Field of Classification Search
CPC ..... B25B 15/007; B25B 15/005; B25G 1/063; B25G 1/066; B25G 1/085; B26B 11/00; B25F 1/00; B25F 1/02
USPC .... 81/177.4, 177.6, 439; 206/234, 229, 349; 7/138, 165, 167, 169, 170; D8/105, 84, D8/81
See application file for complete search history.

(56) References Cited

U.S. PATENT DOCUMENTS

| | | | | |
|---|---|---|---|---|
| 4,677,835 | A | 7/1987 | Almblad | |
| 5,328,026 | A | 7/1994 | Newman | |
| D353,759 | S * | 12/1994 | Flynn | D8/105 |
| 5,620,090 | A * | 4/1997 | Beeley | B25B 13/56 206/234 |
| 5,678,939 | A * | 10/1997 | Ross | B43K 5/005 401/192 |
| 6,460,698 | B1 * | 10/2002 | Wang | B25F 1/02 206/234 |
| 6,571,940 | B2 * | 6/2003 | Newman | A45C 11/00 206/234 |
| 7,530,295 | B2 * | 5/2009 | Jones | B25F 1/00 81/124.4 |
| 9,840,001 | B2 * | 12/2017 | Neubauer | B25B 15/005 |
| 2011/0088522 | A1 * | 4/2011 | Floyd | B25B 15/00 81/438 |
| 2011/0173759 | A1 * | 7/2011 | Taiga | B25B 27/0071 7/118 |
| 2014/0143958 | A1 * | 5/2014 | Barr | B25F 1/00 7/138 |

(Continued)

*Primary Examiner* — Monica S Carter
*Assistant Examiner* — Makena S Markman
(74) *Attorney, Agent, or Firm* — Robert O. Blinn

(57) ABSTRACT

A multiple tool includes a flat assembly having at least a first flat handle portion and a second flat handle portion and at least one removable tool bit. The first and second flat handle portions both present first corresponding engageable features which are able to be interconnected at least indirectly in a flat relationship to at least partially assemble the flat assembly. The first engageable features may also be disconnected so that the first and second flat handle portions are able to be separated. The separated first and second flat handle portions each present second corresponding connectable features which are able to be interconnected with each other in order to assemble a non-flat handle assembly. The non-flat handle assembly also presents at least one tool bit recess which is suitable for receiving the at least one tool bit thereby providing a tool which includes a handle and a tool bit.

9 Claims, 4 Drawing Sheets

(56) References Cited

U.S. PATENT DOCUMENTS

2015/0240524 A1* 8/2015 Olroyd ..... E05B 19/20
81/15.9

* cited by examiner

FLAT MULTIPLE TOOL

FIELD

This invention relates to a flat multiple tool which is able to be reconfigured into a non-flat handle which is able to selectively hold various tool bits.

BACKGROUND

Prior art multiple tools are known that are fashioned from a single flat plate or flat sheet of material and which are highly compact and therefore suitable retaining in a pocket or even a wallet. One limitation of such flat tools is that they are only able to present those tool elements that are able to be formed in a small flat piece of material. Further, such prior art multi-tools generally do not provide a handle which is so often useful in the manipulation of a hand tool. What is needed is a multi-tool that is able to be configured in a compact flat format but which is also able to be reconfigured for providing a suitable handle and for presenting various tool elements which may be used for workpiece engaging operations such as tightening and untightening screws and the like.

SUMMARY

The above described needs are addressed by a flat multiple tool which is able to be arranged as a flat assembly and which includes elements which are able to be re-arranged into a non-flat handle. The non-flat handle is also able to receive and hold at least one tool bit. The multiple tool includes at least a first flat handle portion and a second flat handle portion and at least one tool bit which is releasably received by the flat assembly. The first and second flat handle portions both present first corresponding engageable features which are able to be engaged so that the first and second flat handle portions are able to be connected at least indirectly with respect to each other in a flat relationship to at least partially assemble the flat assembly. The first engageable features of the first and second flat handle portions are also arranged to be releasable so that the first and second flat handle portions are able to be separated. The separated first and second flat handle portions both present second corresponding engageable features which are able to be engaged with each other in order to assemble the first and second flat handle portions into a non-flat handle assembly. The non-flat handle assembly also presents at least one tool bit recess suitable for receiving the at least one tool bit thereby providing a tool which includes a handle and a tool bit.

DETAILED DESCRIPTION

Figure 1:
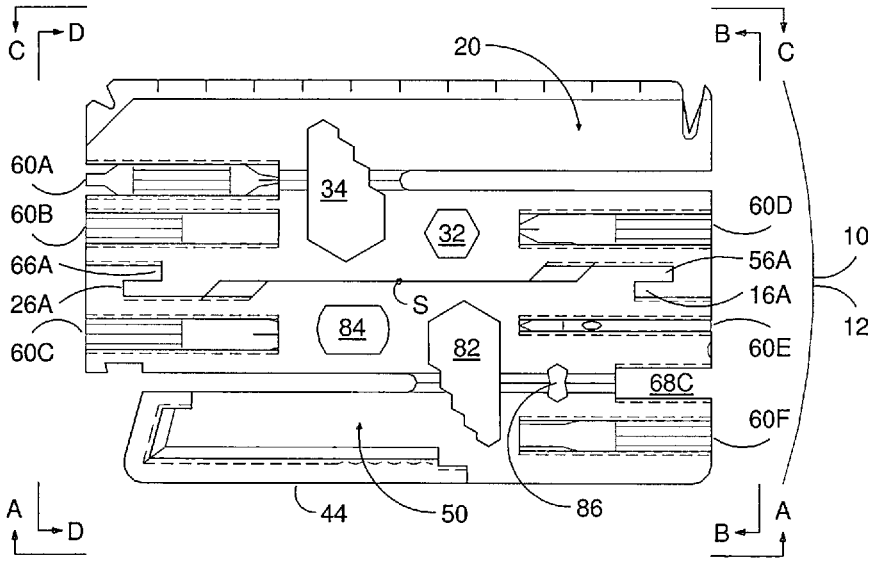
FIG. 1 is a plan view of a first embodiment of the flat multiple tool showing the flat multiple tool assembled as a flat assembly.
Figure 2:
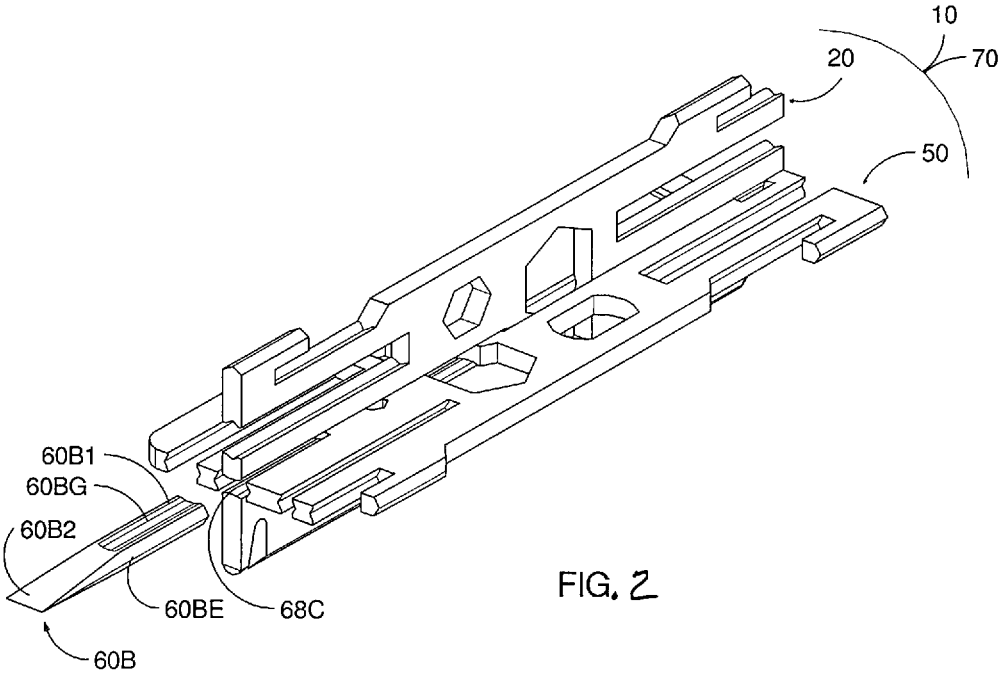
FIG. 2 is a perspective view of the first embodiment of the flat multiple tool showing a first flat handle portion and a second handle portion re-assembled into a non-flat handle assembly.

Referring to the figures, FIG. 1 provides a plan view of one embodiment of a flat multiple tool 10. As shown in FIG. 1, flat multiple tool 10 is able to be assembled as a flat assembly 12. Flat assembly 12 includes at least a first flat handle portion 20 and a second flat handle portion 50. In this example, first and second handle portions 20 and 50 securely and releasably receive for storage and for later use a plurality of tool bits 60A, 60B, 60C, 60D, 60E and 60F. Tool bits 60A, 60B, 60C, 60D, 60E and 60F are received and held by corresponding tool bit recesses 12A, 12B, 12C, 12D, 12E and 12F (indicated in FIG. 4). As will be described in greater detail below, first flat handle portion 20 and second flat handle portion 50 are able to be assembled into a flat assembly 12. As will also be described in greater detail below, first flat handle portion 20 and second flat handle portion 50 are able to be separated from each other and re-assembled to make a non-flat handle assembly 70 as shown in FIG. 2. Non-flat handle assembly 70 further presents a recess 72 which is shaped to releasably but securely receive any one of plurality of tool bits 60A-60F. Recess 72 will also be described in greater detail below.

Figure 3:
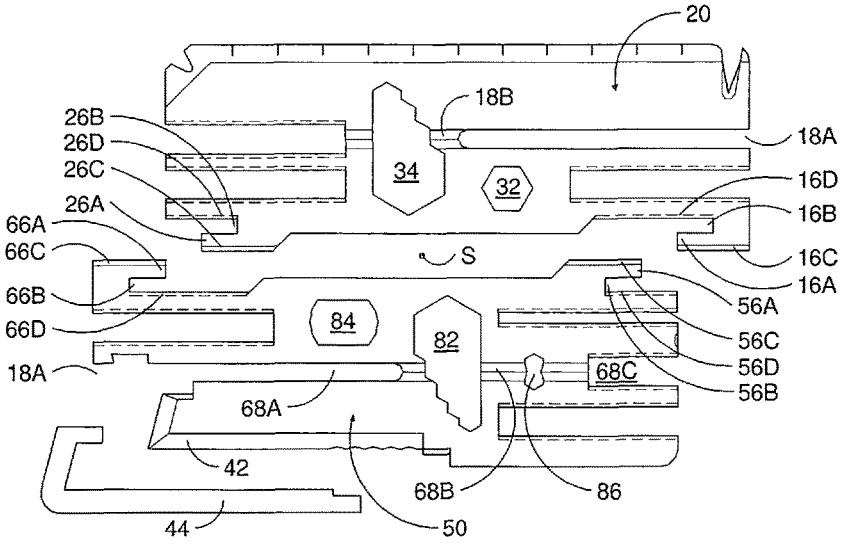
FIG. 3 is a plan view of the first embodiment of the flat multiple tool showing the flat multiple tool exploded into a flat relationship.
Figure 3A:
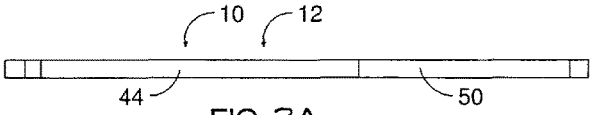
FIG. 3A is a side view of the first embodiment of the flat multiple tool taken from plane A-A indicated in FIG. 1.
Figure 3B:
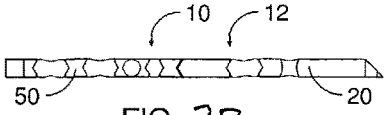
FIG. 3B is a side view of the first embodiment of the flat multiple tool taken from plane B-B indicated in FIG. 1.
Figure 3C:
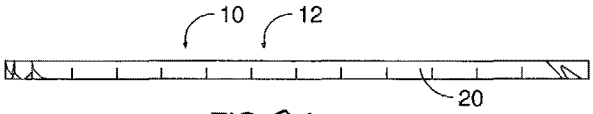
FIG. 3C is a side view of the first embodiment of the flat multiple tool taken from plane C-C indicated in FIG. 1.
Figure 3D:
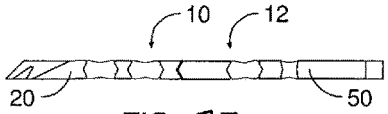
FIG. 3D is a side view of the first embodiment of the flat multiple tool taken from plane D-D indicated in FIG. 1.

The first engageable features of this embodiment make it possible to assemble first flat handle portion 20 and second flat handle portion 50 into a flat assembly 12. These first engageable features may be best understood by referring to FIGS. 3 and 4. As can be seen in FIG. 3, first flat handle portion 20 includes engageable features which are arranged to interlock with corresponding engageable features in second flat handle portion 50 so that first flat handle portion 20 and second flat handle portion 50 are able to be assembled into flat assembly 12. As can be seen in FIG. 3, first flat handle portion 20 presents an inwardly oriented finger 16A which encloses a slot 16B. As can be more easily seen in FIG. 4, the inboard edge of slot 16B presents a groove 16D. The outside edge 16C of finger 16A is double beveled. Similarly, second flat handle portion 50 presents an outwardly oriented finger 56A which partially encloses a slot 56B. The outboard edge 56C of finger 56A is doubled beveled to match groove 16D of slot 16B. The inboard edge of slot 56B (which actually extends beyond the distal end of finger 56A) presents a groove 56D which is shaped to receive the double beveled outboard edge 16C of finger 16A. As can be seen in FIG. 3, the entrance to slot 16B is elongated so that it is possible to slide finger 56A into slot 16B. Further in this example, the left end of first flat handle portion 20 presents engageable features such as a finger 26A which partially encloses a slot 26B and which also presents a double beveled outboard edge 26C which matches a corresponding groove 66D presented by the corresponding end of second flat handle portion 50. The left end of flat handle portion 50 also presents a finger 66A which presents a double beveled outboard edge 66C which is suitable for engaging edge 26D. Thus, in this example, the skilled reader will appreciate that the engageable features on the left side (as seen in FIGS. 1 and 3) are arranged to be symmetrical through point S indicated in FIGS. 1 and 3 with the right side engageable features described above.

Figure 4:
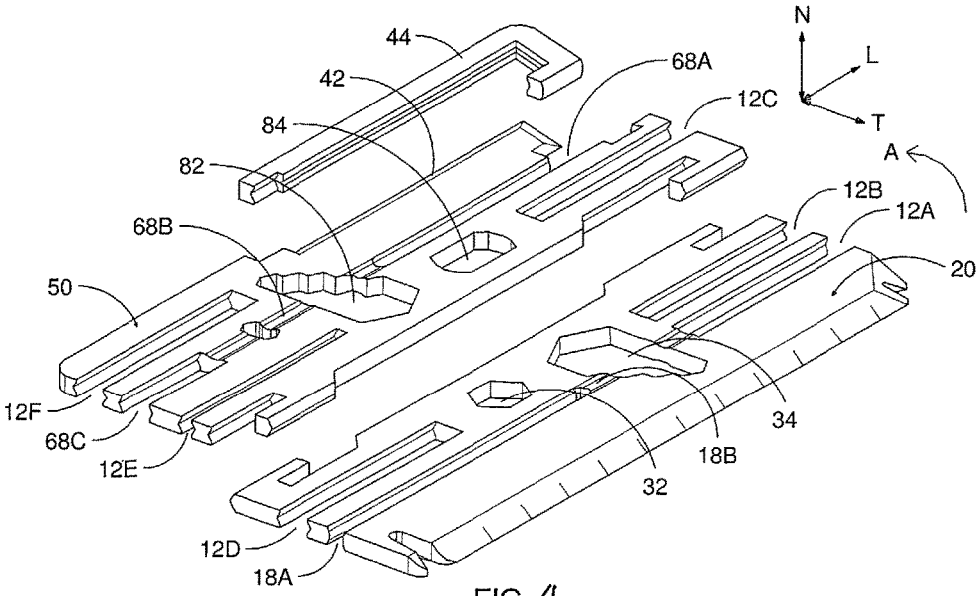
FIG. 4 is a perspective view of the first embodiment of the flat multiple tool showing the flat multiple tool exploded in a flat relationship.

As can be seen in FIG. 4, an axis system indicates the longitudinal direction L, the transverse direction T and the normal direction N. The engageable features described above are arranged so that it is possible to engage and join and second flat handle portions 20 and 50 by translating them relative to each other in the longitudinal direction L as noted above. The engageable features are arranged such that, once joined, first and second flat handle portions 20 and 50 are not able to translate relative to each other in the normal direction N, or in the transverse direction T, or, in this example, to fold or rotate with respect to each other about an axis which would run parallel to the longitudinal direction L. The skilled reader will readily appreciate that other configurations for the engageable features may be selected. For example, corresponding pins and holes which are oriented in the transverse direction T may be an acceptable equivalent for the engageable features described above. Various other forms of prongs and capturing features may also be considered for alternative engageable features.

As can be seen in FIG. 3, first and second flat handle portions 20 and 50, in this example, are generally elongated—that is—each has a length which is substantially greater than its width. Thus, when first and second flat handle portions 20 and 50 are assembled into non-flat handle assembly 70, what results is an elongated handle assembly 70 of generally conventional proportions.

First and second flat handle portions 20 and 50 are also able to be assembled into flat assembly 12 as shown in FIG. 1. This is accomplished by bringing the distal ends of fingers 16A and 56A in close proximity and by bringing the distal ends of the analogous fingers on the left side into close proximity and then sliding the fingers into the respective slots by sliding second flat handle portion 50 to the right (as seen in FIG. 3) so that finger 56A is received by slot 16B and finger 16A is received by slot 56B and so that the analogous fingers are received by the analogous slots on the opposite ends of first and second flat handle portions 20 and 50. Because the interlocking features of groove 16D and beveled edge 56C are spaced apart from beveled edge 16C and groove 56D (and because a symmetrical spaced relationship of such features also exists on the left side), out of plane movement of first and second flat handle portions 20 and 50 with respect to each other is prevented. Thus, flat handle portions 20 and 50 are fixed in a flat orientation and are able to resist out-of-plane bending forces.

The skilled reader should bear in mind that the first corresponding engageable features described above are merely one example of how first corresponding engageable features may be defined in a first flat handle portion and a second flat handle portion in order to allow such flat handle portions to be assembled in a flat assembly. The skilled reader should also be mindful that first and second handle portions may be assembled in a flat assembly by being interconnected in relation to each other in an indirect manner and not necessarily directly to each other. And, further, it is not necessary to this invention that the first and second handle portions comprise the entirety or even most of flat assembly 12 as is the case with the example shown in FIGS. 1-4 in which first and second flat handle portions 20 and 50 comprise most if not all of flat assembly 12. In other embodiments, the first and second flat handle portions could be relatively narrow, elongated flat handle portions which never-the-less could be assembled to make a useful non-flat handle assembly much as described below and much as shown in FIG. 2. Thus, other remaining portions of the flat tool assembly would be left available to provide other tool capabilities.

First and second flat handle portions 20 and 50 are also able to be assembled into non-flat handle assembly 70 as shown in FIG. 2. As can be seen in FIG. 4, first flat handle portion 20 presents a handle assembly slot 18A and second flat handle portion 50 presents a handle assembly slot 68A. The skilled reader will note that both handle assembly slots 18A and 68A run longitudinally or lengthwise with respect to their respective flat handle portions. Accordingly, the corresponding grooves which receive the inside surfaces of those slots also run longitudinally. This results in a handle assembly which is generally elongated and conventional in shape and proportions. In this example, the inside edges of slots 18A and 68A are cylindrically convex. (They also may alternatively be double beveled or be fashioned to present some other generally continuous protruding or even recessed cross section.) In this example, a set of grooves 18B are defined in first handle portion 20 which are aligned with handle assembly slot 18A. In this example, grooves 18B are cylindrically concave in order to match the cylindrically convex inside edges of handle assembly slot 68A (as will be noted below). The skilled reader will appreciate that as long as the corresponding features are uniform, continuous and register with each other, a firm engaging assembly will be possible regardless of the cross sectional shape selected for those features. Flat handle portion 50 also presents a set of grooves 68B which, in this example, are aligned with handle assembly slot 68A. Grooves 68B are also cylindrically concave to match the cylindrically convex inside edges of handle assembly slot 18A. Second flat handle portion 70 also presents a tool bit holding slot 68C which is shaped to receive and hold the various tool bits which are received and held (for storage for selective use) by flat assembly 12 as shown in FIG. 1.

With reference to FIGS. 2 and 4, the assembly of non-flat handle assembly 70 may be accomplished by first arranging first and second flat handle portions 20 and 50 in disassembled condition as shown in FIG. 4. Next, as is shown in FIG. 4, first flat handle portion 20 may be rotated 90 degrees in the direction shown by arrow A. Then, it is possible to slide second flat handle portion 20 into first flat handle portion 50 by sliding slot 18A of second flat handle portion into slot 68A of first flat handle portion 50. The cylindrically convex inside edges of slots 18A and 68A will be received by the corresponding concave grooves 68B and 18B respectively of each opposite handle portion to effect an interlocking engagement of first and second handle portions 20 and 50 into a non-flat handle assembly 70 as shown in FIG. 2.

As can be seen in FIG. 2, in the assembled non-flat tool assembly 70, tool bit holding slot 68C is available for receiving a tool bit 60B. As can be seen in FIG. 2, tool bit 60B presents a mounting end 60B1 and a tool end 60B2 (which in this example is a flat head screw driver). Mounting end 60B1 of tool bit 60B presents opposite cylindrically concave surfaces 60BG which match the opposite cylindrically convex surfaces of slot 18A of first flat handle portion 20. Mounding end 60B1 of tool bit 60B also present opposite double beveled outside edges 60BE that match the grooves presented by tool bit holding slot 68C. The skilled reader will recall that tool bit 60B is only one of what may be a plurality of tool bits which are removably held by flat assembly 12 as noted above. Such tool bits be fashioned to present a number of tool features suitable for various operations.

As can be seen in FIG. 4, first flat handle portion 20 and second flat handle portion 50 also present other tool elements. In this example, a knife blade 42 is defined along one edge of flat handle portion 50. Still further, a knife edge cover 44 is provided for safely covering knife blade 42 when not in use. Further, in this example, first handle portion 20 presents tool openings which are suitable for engaging hex nuts or hex bolt heads. A tool feature 32 of first flat handle portion 20, in this example, is arranged to receive a hex nut or hex bolt head. A tool feature 34 of first flat handle portion 20 is arranged to receive a hex nuts or hex bolt heads of four different sizes. A tool feature 82 of second flat handle portion 70 is arranged to receive hex nuts or hex bolt heads of five different sizes. A tool feature 84 of second flat handle portion 50 is arranged to receive a hex nut or bolt head or a square nut of a particular size. A tool opening 86 is also specifically shaped to receive the proximal ends of tool bits 60A-60D and 60F. It is believed that this alternate tool bit holding method would provide greater leverage for increased torque. The skilled reader should note that tool features 32 and 34 are intended for use when first flat handle portion 20 is separated from second flat handle portion 50 as shown in FIG. 4 (with the exception that knife edge cover 44 should be installed to cover knife blade 42 as shown in FIG. 1 when either second flat handle portion 50 is used separately or when assembled as part of non-flat handle assembly 70). Similarly, tool features 82, 84 and 86 are intended for being used when second flat handle portion 50 is separated from first flat handle portion 20 as shown in FIG. 4

It is preferable that first and second flat tool portions 20 and 50 be fashioned from a strong, tough material such as stainless steel or titanium. A knife blade guard 70 is indicated in FIGS. 1-4. Knife blade guard 70 may be fashioned from a plastic or even rubber material. It may be advantageous to fashion tool bits such as tool bits 60A, 60B, 60C, 60D, 60E and 60F from a very hard, tough material. Even materials such as tungsten carbide are not out of the question for tool bits 60A, 60B, 60C, 60D, 60E and 60F.

Figure 5:
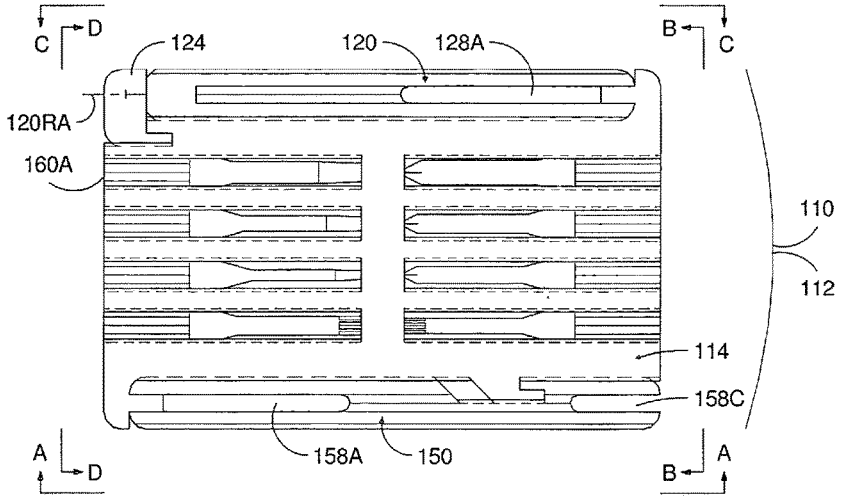
FIG. 5 is a plan view of a second embodiment of the flat multiple tool showing the flat multiple tool assembled as a flat assembly.
Figure 6:
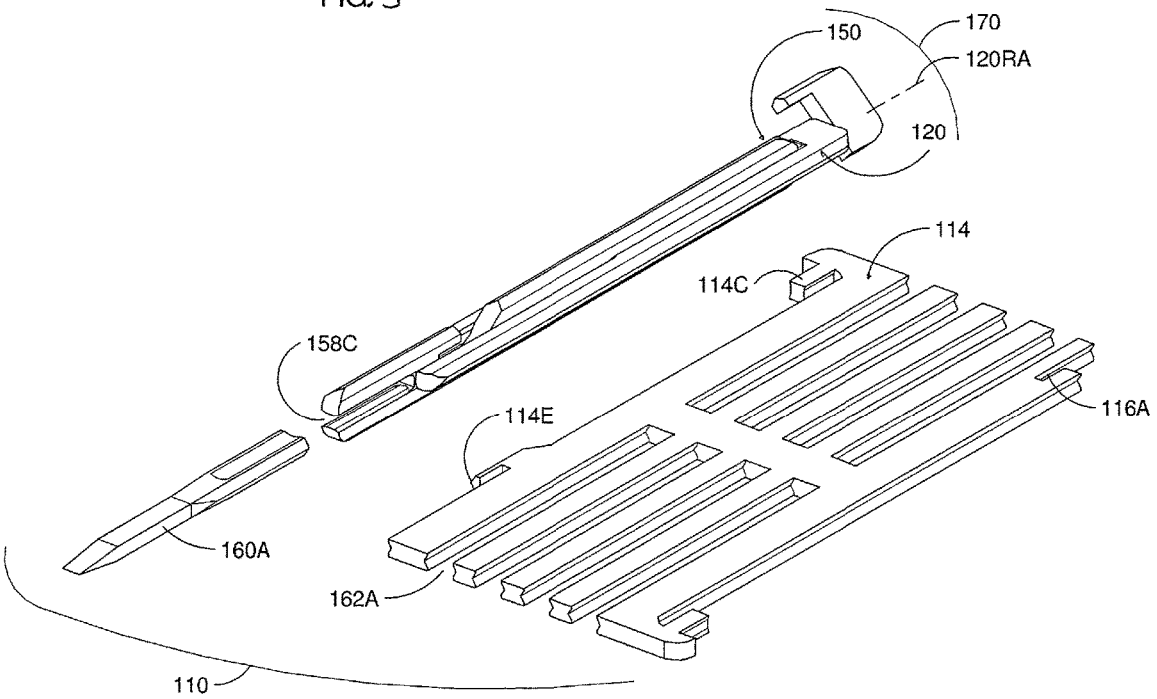
FIG. 6 is a perspective view of the second embodiment of the flat multiple tool showing a first flat handle portion and a second handle portion separated from the flat assembly and re-assembled into a non-flat handle assembly which presents a recess for receiving a tool bit.

FIGS. 5-8 illustrate a second embodiment of a flat multiple tool, namely flat multiple tool 110. Referring to the figures, FIG. 5 provides a plan view of flat multiple tool 110. As shown in FIG. 5, flat multiple tool 110 is able to be assembled as a flat assembly 112. Flat assembly 112 includes a first flat handle portion 120 and a second flat handle portion 150. However, with flat multiple tool 110, first and second handle portions 120 and 150 are not attached to each other in flat assembly 112 but are attached to opposite sides of a tool bit storage portion 114. As will be described in greater detail below, first flat handle portion 120 and second flat handle portion 150 are able to be removably attached to opposite sides of tool bit storage portion 114 to complete flat assembly 112. In this example, tool bit storage portion 114 presents a plurality of tool bit recesses such as tool bit recess 162A for storing a plurality of tool bits such as tool bit 160A. As will be described in greater detail below, first flat handle portion 120 and second flat handle portion 150 are able to be separated from tool bit storage portion 114 and re-assembled with each other to make a non-flat handle assembly 170 as shown in FIG. 6. Non-flat handle assembly 170 further presents a recess 158C which is shaped to releasably but securely receive any one of plurality of tool bits such as tool bit 160A.

Figure 7:
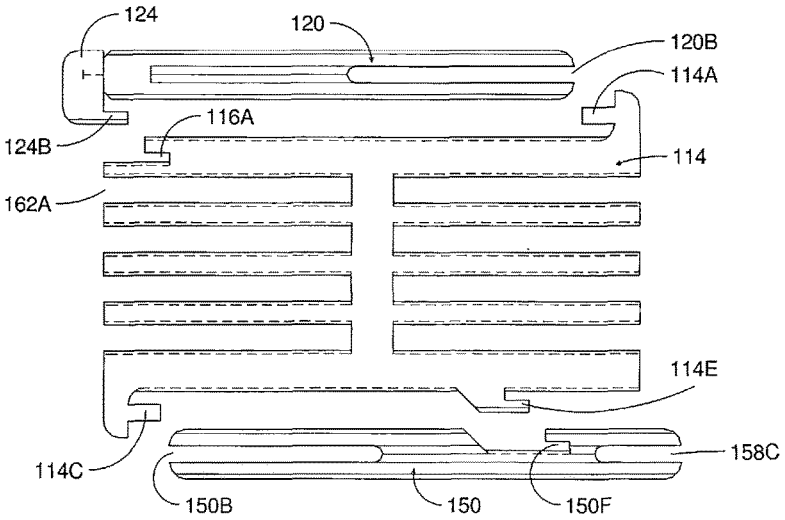
FIG. 7 is a plan view of the second embodiment of the flat multiple tool showing the flat multiple tool exploded into a flat relationship.
Figure 7A:
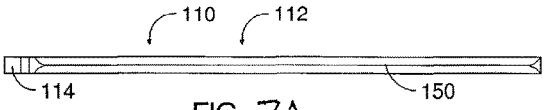
FIG. 7A is a side view of the second embodiment of the flat multiple tool taken from plane A-A indicated in FIG. 5.
Figure 7B:
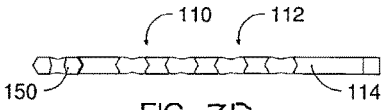
FIG. 7B is a side view of the second embodiment of the flat multiple tool taken from plane B-B indicated in FIG. 5.
Figure 7C:
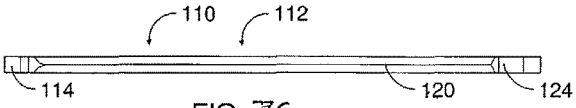
FIG. 7C is a side view of the second embodiment of the flat multiple tool taken from plane C-C indicated in FIG. 5.
Figure 7D:
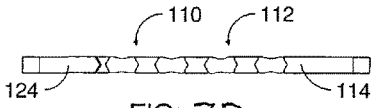
FIG. 7D is a side view of the second embodiment of the flat multiple tool taken from plane D-D indicated in FIG. 5.

As was the case with the first embodiment described above, the first engageable features of the second embodiment make it possible to assemble first flat handle portion 120 and second flat handle portion 150 onto tool bit storage portion 114 to complete flat assembly 112. These first engageable features may be best understood by referring to FIG. 7. As can be seen in FIG. 7, first flat handle portion 120 includes engageable features which are arranged to interlock with corresponding engageable features in tool bit storage portion 114 so that first flat handle portion 120 and tool bit storage portion 114 are able to be assembled in order to partially assemble flat assembly 112. As can be seen in FIG. 7, first flat handle portion 120 includes an optional pivoting portion 124 which is arranged to rotate about axis 120RA (or rather to allow the rotation of non-flat handle assembly 170 about axis 120RA for precision work). Axis 120RA is indicated in FIGS. 5 and 6. Pivoting portion 124 presents an inwardly oriented finger 124B. As can be seen in FIG. 7, tool storage portion also presents an outwardly oriented slot 116A which is adapted to receive finger 124B. At the opposite end of the structure, tool storage portion 114 presents an inwardly oriented finger 114A which has cylindrically concave opposite surfaces. The opposite end of first flat handle portion 120 presents an elongated slot 120B which has cylindrically convex opposite surfaces which match the cylindrically convex opposite surfaces of finger 114A. On the opposite side, tool bit storage portion 114 presents a finger 114C which presents cylindrically concave surfaces which is received by a slot 150B in second flat handle portion 150 which also presents matching cylindrically convex surfaces. And further, a double beveled finger 114E protruding from tool bit storage portion 114 is similarly fashioned to be received by an elongated grooved slot 150F in second flat handle portion 150. Thus, both first and second flat handle portions 120 and 150 can be mounted to tool storage portion 114. Because of the double beveling and matching concave and convex surfaces described above, flat handle portions 120 and 150 are not able to be slid out of plane from their stored positions in flat assembly 112 as shown in FIG. 5. To be removed from their stored positions as shown in FIG. 5, they must be slid longitudinally so as to disengage the engaging features described above and then translated laterally. As noted above for the engageable features described for multiple tool 10, the engageable features for multiple tool 110 may also be replaced by equivalent engageable features which accomplish releasable joining in a joint which is resistant to transverse separation, separation in a normal direction or rotation or bending about a longitudinal axis which passes generally through the joined engageable features.

Figure 8:
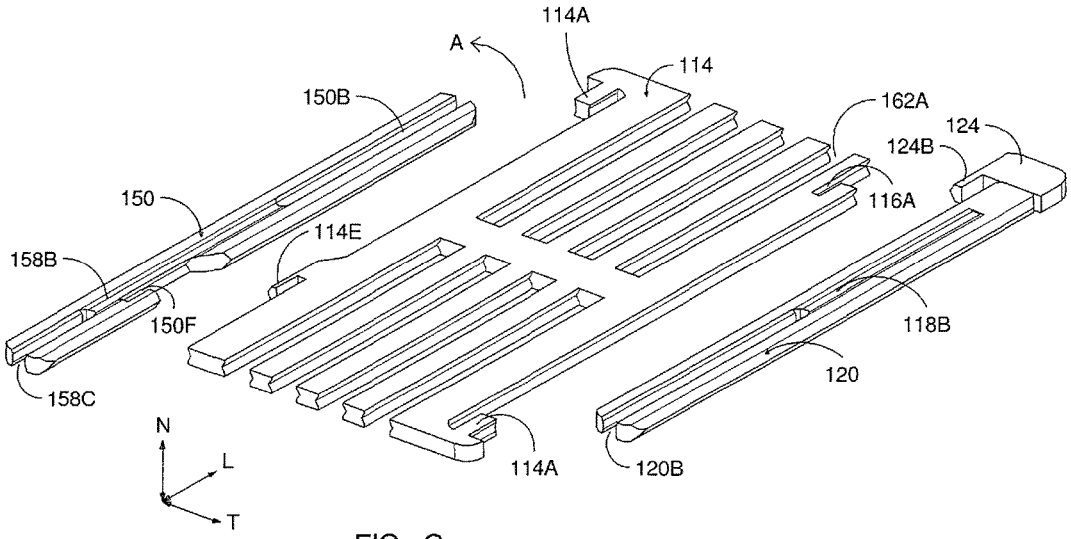
FIG. 8 is a perspective view of the second embodiment of the flat multiple tool showing the flat multiple tool exploded in a flat relationship.

First and second flat handle portions 120 and 150 are also able to be assembled into non-flat handle assembly 170 as shown in FIG. 6 and in a manner which is similar to that which is described for first embodiment multiple tool 10 above. As can be seen in FIG. 8, first flat handle portion 120 presents a handle assembly slot 120B and second flat handle portion 150 presents a handle assembly slot 150B. In this example, as was the case for multiple tool 10 described above, the inside edges of slots 120B and 150B are cylindrically convex. (They also may alternatively be double beveled or be fashioned to present some other generally continuous protruding or even recessed cross section.) In this example, a set of cylindrically concave grooves 118B are defined in first handle portion 120 which are aligned with handle assembly slot 120B. Also in this example, grooves 118B are cylindrically concave in order to match the cylindrically convex inside edges of handle assembly slot 150B (as will be noted below). The skilled reader will appreciate that as long as the corresponding features are uniform, continuous and register with each other, a firm engaging assembly will be possible generally regardless of the cross sectional shape selected for those features. Second flat handle portion 150 also presents a set of grooves 158B which are aligned with handle assembly slot 150B. Grooves 158B are also concave to match the convex inside edges of handle assembly slot 120B. Second flat handle portion 150 also presents a tool bit holding slot 158C which is shaped to receive and hold the various tool bits such as tool bit 160A which are received and held (for storage for selective use) by flat assembly 112 as shown in FIG. 5.

With reference to FIGS. 6 and 8, the assembly of non-flat handle assembly 170 may be accomplished by first arranging first and second flat handle portions 120 and 150 in a disassembled condition as shown in FIG. 8. Next, as is shown in FIG. 8, second flat handle portion 150 may be rotated 90 degrees in the direction shown by arrow A. Then, it is possible to slide second flat handle portion 150 into first flat handle portion 120 by sliding slot 150B of second flat handle portion 150 into slot 120B of first flat handle portion 120 until grooves 118B of first flat handle portion 120 fully receive the inside surfaces of slot 150B of second flat handle portion 150 and grooves 158B of second flat handle portion 150 fully receive the inside surfaces of slot 120B of first flat handle portion 120 thereby completing the assembly of non-flat handle assembly 170 as shown in FIG. 6.

As can be seen in FIG. 6, in the assembled non-flat handle assembly 170, tool bit holding slot 158C is available for receiving a tool bit such as tool bit 160A. The skilled reader will note with reference to FIG. 6 that tool bit receiving slot 158C presents cylindrically convex inside surfaces which match corresponding concave outside surfaces presented by tool bit 160 (which is merely exemplary of the plurality of tool bits stored by tool bit storage portion 114). The skilled reader will observe that optional pivoting portion 124 which is rotatably mounted to the proximal end of first flat handle portion 120 for rotation about axis 120RA indicated in FIGS. 5 and 6. Optional pivoting portion 124 makes it possible for a user to delicately rotate non-flat handle assembly 170 in a controlled manner to facilitate delicate, precise operations.

As was the case for first embodiment multiple tool 10, it is preferable that first and second flat tool portions 120 and 150 be fashioned from a strong, tough material such as stainless steel or titanium. It is particularly important that the material defining tool slot 158C of second flat handle portion 150 be particularly strong and tough for securely holding tool bits such as tool bit 160A. However, it may be the case that tool storage portion 114 could be fashioned from a lesser material such as an injection molded plastic material or the like. Tool bits such as tool bit 160A would also preferably be fashioned from a strong, tough material such as stainless steel or titanium or even a very hard, tough material such as tungsten carbide.

As can be seen from the above detailed description, the embodiments of the multiple tool described above provide a means for creating a considerable range of extremely compact useful tools which would able to incorporate a multitude of tool bits for a multitude of tool functions. With the above described multiple tools and other embodiments of the above described multiple tool, it is possible to quickly assemble a useful, non-flat handle which is able to receive one of a plurality of tool bits and it is also possible to disassemble such a non-flat handle and re-assemble the multiple tool components into an extremely compact flat assembly. Such multiple tool which provides a non-flat handle assembly for use and a highly compact flat assembly when not in use provides a very compact useful tool system which utility and usefulness which significantly exceeds that offered by known flat tool devices.

While certain forms of this invention have been illustrated and described, it is not limited thereto, except in so far as such limitations are included in the following claims and allowable equivalents thereof.

Having thus described the invention, what is claimed as new and desired to be secured by Letters Patent is:

1. A multiple tool, comprising:

a flat assembly that includes at least a first generally elongated flat handle portion and a second generally elongated flat handle portion and at least one removable tool bit, the first and second flat handle portions both presenting first corresponding engageable features that are inter-connectable at least indirectly in a flat relationship to at least partially assemble the flat assembly, the first engageable features of the first and second flat handle portions also being able to be disconnected so that the first and second flat handle portions are able to be separated, the first and second flat handle portions each presenting second corresponding connectable features including at least one feature selected from a group consisting of a slot and a groove, the corresponding connectable features being arranged to receive each other in order to assemble the first and second flat handle portions into a non-flat handle assembly, the non-flat handle assembly also presenting at least one tool bit recess that is suitable for receiving a tool bit.

2. The multiple tool of claim 1, wherein:

the flat assembly presents at least one tool bit holding recess that is suitable for releasably holding at least one tool bit, the at least one tool bit being able to be received by the tool bit recess of the non-flat handle assembly.

3. A multiple tool, comprising:

a flat assembly that includes at least a first generally elongated flat handle portion and a second generally elongated flat handle portion and at least one removable tool bit, the first and second flat handle portions both presenting first corresponding engageable features that are inter-connectable at least indirectly in a flat relationship to at least partially assemble the flat assembly, the first engageable features of the first and second flat handle portions also being able to be disconnected so that the first and second flat handle portions are able to be separated, the first and second flat handle portions also presenting longitudinally oriented slots and grooves that are correspondingly arranged to receive each other such that the first and second flat handle portions are able to be assembled into an non-flat handle assembly, the non-flat handle assembly also presenting at least one tool bit recess that is suitable for receiving a tool bit.

4. The multiple tool of claim 3, wherein:

the first and second flat handle portions comprise a portion of the flat assembly.

5. The multiple tool of claim 3, wherein:

the flat assembly includes a first flat handle portion, a second flat handle portion and a tool bit storage portion.

6. The multiple tool of claim 5, wherein:

the first flat handle portion is attached to the tool bit storage portion and the second flat handle portion is attached at least indirectly to the tool bit storage portion to assemble the flat assembly.

7. The multiple tool of claim 1, wherein:

the engageable features for assembling the flat handle portions into a flat assembly include corresponding slots and fingers that are arranged to receive each other in an interlocking fashion, the slots and fingers having longitudinal features that are suitable for preventing out of plane translation of the flat handle portions with respect to the flat assembly when the flat assembly is assembled.

8. The multiple tool of claim 3, wherein:

the flat assembly presents at least one tool bit holding recess that is suitable for releasably holding at least one tool bit, the at least one tool bit being able to be received by the tool bit recess of the non-flat handle assembly.

9. The multiple tool of claim 3, wherein:

the engageable features for assembling the flat handle portions into a flat assembly include corresponding slots and fingers that are arranged to receive each other in an interlocking fashion, the slots and fingers having longitudinal features that are suitable for preventing out of plane translation of the flat handle portions with respect to the flat assembly when the flat assembly is assembled.

* * * * *